US007466276B1

(12) United States Patent
Chen

(10) Patent No.: US 7,466,276 B1
(45) Date of Patent: Dec. 16, 2008

(54) BROADBAND INVERTED-F ANTENNA

(75) Inventor: Po-Chuan Chen, Hsinchu (TW)

(73) Assignee: Alpha Networks Inc., Hsinchu (TW)

( * ) Notice: Subject to any disclaimer, the term of this patent is extended or adjusted under 35 U.S.C. 154(b) by 21 days.

(21) Appl. No.: 11/812,285

(22) Filed: Jun. 18, 2007

(51) Int. Cl.
*H01Q 1/24* (2006.01)

(52) U.S. Cl. ..... 343/702; 343/700 MS

(58) Field of Classification Search ..... 343/700 MS, 343/702, 829, 846
See application file for complete search history.

(56) References Cited

U.S. PATENT DOCUMENTS 5,926,150 A * 7/1999 McLean et al. ..... 343/846
6,404,395 B1 * 6/2002 Masuda ..... 343/702
7,345,631 B2 * 3/2008 Kim et al. ..... 343/700 MS
2003/0038749 A1 * 2/2003 Chen ..... 343/700 MS
2003/0210191 A1 * 11/2003 Mohammadian et al. .... 343/702

* cited by examiner

*Primary Examiner*—Tho G Phan
(74) *Attorney, Agent, or Firm*—Bacon & Thomas, PLLC

(57) ABSTRACT

An antenna body of a broadband inverted-F antenna is printed on a circuit board, wherein an interval is maintained between the antenna body and a grounding plane disposed at a position proximate to an edge of the circuit board. The antenna body is divided into a first, a second and a third portions. An end of the first portion is extended towards the grounding plane to form the short circuit line, and another end of the first portion is extended towards the grounding plane to form the feed line. A first end of the second portion is connected to another end of the first portion, a second end of the second portion is connected to an end of the third portion, and the first portion has a wire width smaller than the third portion, so that no metal is existing between the second and third portions and the grounding plane.

11 Claims, 12 Drawing Sheets

BROADBAND INVERTED-F ANTENNA

FIELD OF THE INVENTION

The present invention relates to an antenna, and more particularly to a broadband inverted-F antenna capable of transmitting and receiving wireless signals without worrying about dead spots.

BACKGROUND OF THE INVENTION

In general, the present network device manufacturers usually integrate an antenna diversity function into a wireless network device such as a wireless access point or a wireless router to provide the best signal transmitting and receiving quality to the wireless network device and achieve a full coverage of transmitting and receiving signals without worrying about dead spots. The present wireless network devices further includes another antenna inside a casing, in addition to the antenna exposed from the casing, and most of the internal antennas are chip antennas, printed monopole antennas and inverted-F antennas.

However, the wireless network devices tend to be developed with a compact design, so that when wireless network device manufacturers design a wireless network device, the space of a circuit board in the wireless network device for installing another antenna becomes increasingly smaller. Furthermore, the requirement for various different types of components and the mechanical design of the wireless network device further cause more limitations to the space of designing and installing another antenna, so that the other antenna is unable to achieve the best signal transmitting and receiving quality, and the reasons are elaborated as follows:

1. Chip antenna 10: Referring to FIG. 1, a low temperature co-fired ceramic (LTCC) technology is used for producing a chip antenna 10 featuring a small size, and thus the LTCC technology obviously provides a flexible way of installing the chip antenna 10 in a limited internal space of the wireless network device. However, the internal mechanism of the wireless network device is usually different from the coefficient of a circuit board 2 for the practical applications of the chip antenna 10, and thus the chip antenna 10 often cannot be installed according to the best condition as recommended and described in a data sheet of the chip antenna 10, and the bandwidth performance and the radioactive efficiency become very low, and the additional cost of installing a chip antenna cannot meet the requirement of a low cost.
2. Printed monopole antenna 12: Referring to FIG. 2, a printed monopole antenna 12 is printed on a circuit board 2 through a microstrip, and a portion of the microstrip is a feed line 122, and a signal line 120 is extended from the feed line 122 across a grounding plane 20 of the circuit board 2. The advantage of the printed monopole antenna 12 resides on its simple architecture and easy design, and any shape of printed monopole antenna 12 can be formed to fit the layout of a circuit board 2. However, different shapes of the printed monopole antennas 12 for wireless network devices are designed according to the designer's habit and the coefficients of mechanism and circuit board 2 usually come with a big discrepancy and a low bandwidth performance, and thus causing tremendous problems to antenna manufacturers and designers.
3. Inverted-F antenna 14: Referring to FIG. 3, the inverted-F antenna 14 is printed on a circuit board 2, and the circuit board 2 has a grounding plane 20 disposed proximate to an edge of the circuit board 2, and the inverted-F antenna 14 is comprised of a feed line 140, a short circuit line 142 and an antenna body 144, wherein an end of the feed line 140 and an end of the short circuit line 142 are connected to the grounding plane 20, and another end of the short circuit line 142 is extended towards an edge of the circuit board 2, and an end of the antenna body 144 is connected to the short circuit line 142, and another end of the antenna body 144 is extended along an edge of the circuit board 2 and connected to another end of the feed line 140 and then further extended along the edge of the circuit board 2 to a predetermined length. From the description above, the inverted-F antenna 14 is a change of the shape of a printed monopole antenna 12. Unlike the shape of the printed monopole antenna 12, the special shape of inverted-F antenna 14 allows the inverted-F antenna to occupy a smaller area of the circuit board 2 than a printed monopole antenna 12. Referring to FIG. 4, the widths of the feed line 140 and the short circuit line 142 are both 0.85 mm, their lengths are 5 mm, the distance between the feed line 140 and the short circuit line 142 is 2.3, the width of the antenna body 144 is 0.7 mm, and the length of the antenna body 144 is 18.63 mm. Referring to FIG. 5, the testing and measurement of a circuit design indicate that the bandwidth of a return loss −10 dB falls within 2.338~2.508 GHz, and the inverted-F antenna 14 generally comes with a problem of insufficient bandwidth.

In view of the description above, a common drawback of the aforementioned antennas 10, 12, 14 resides on low bandwidth and poor couple error vector magnitude (EVM), and thus affecting the transmission throughput. Since the wireless network device tends to be small in size, and the mechanical requirement tends to be high, the position for installing an antenna is very limited, and thus it is necessary to develop a wideband antenna with a simple shape and a small size.

SUMMARY OF THE INVENTION

In view of the foregoing shortcomings of the prior art, the inventor of the present invention based on years of experience in the related industry to conduct extensive researches and experiments, and finally developed a wideband inverted-F antenna in accordance with the present invention to overcome the shortcomings of the prior art.

It is a primary objective of the present invention to provide a broadband inverted-F antenna printed on a circuit board, and the inverted-F antenna comprises an antenna body, a short circuit line and a feed line, wherein a predetermined distance is maintained between the antenna body and a grounding plane disposed at a position proximate to an edge of the circuit board, and the antenna body further comprises a first portion, a second portion and a third portion. The first portion is extended towards the grounding plane from a position proximate to an end of the first portion and in a direction facing a side of the grounding plane to form the short circuit line, and the first portion is extended towards the grounding plane from a position proximate to another end of the first portion and in a direction facing a side of the grounding plane to form the feed line. Further, the wire width of the first portion is smaller than the wire width of third portion, and the wire width of the second portion is tapered from a first end to a second end of the second portion, and the first end of the second portion is connected to another end of the first portion, and the second end of the second portion is connected to an end of the third portion, and thus there is no metal existed between the second and third portions and the grounding plane, and the effective bandwidth of the broadband inverted-F antenna can be adjusted to a meet the required bandwidth of a product that adopts the broadband inverted-F antenna, so as to effectively improve the tolerance for mass production.

To make it easier for our examiner to understand the objective, technical characteristics and effects of the present invention, preferred embodiments will be described with accompanying drawings as follows;

DETAILED DESCRIPTION OF THE PREFERRED EMBODIMENTS

Figure 1:
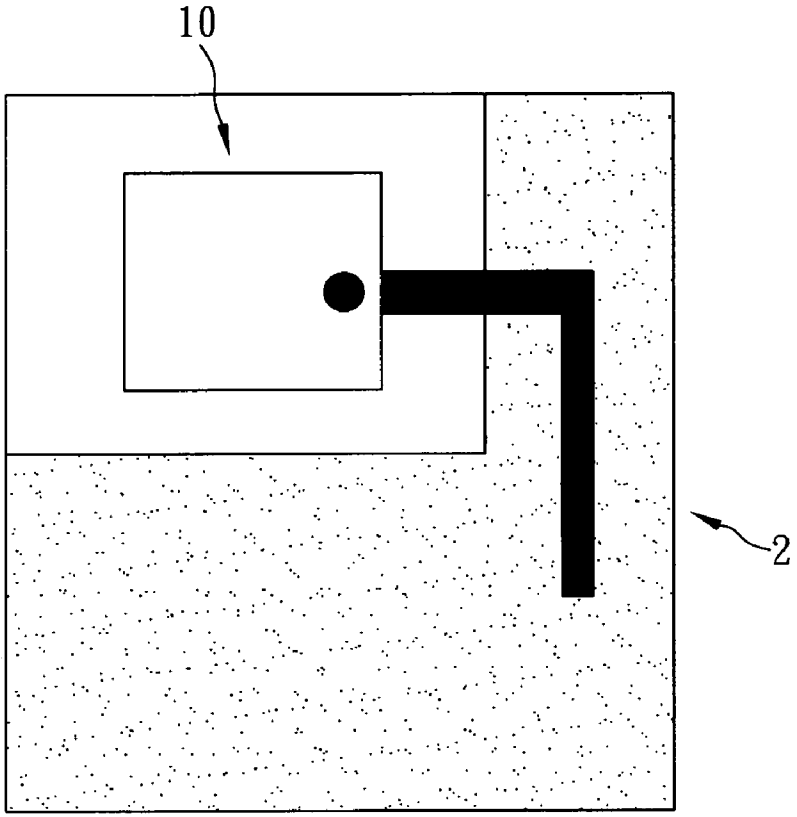
FIG. 1 (Prior Art)
FIG. 1 is a schematic view of a prior art chip antenna.
Figure 2:
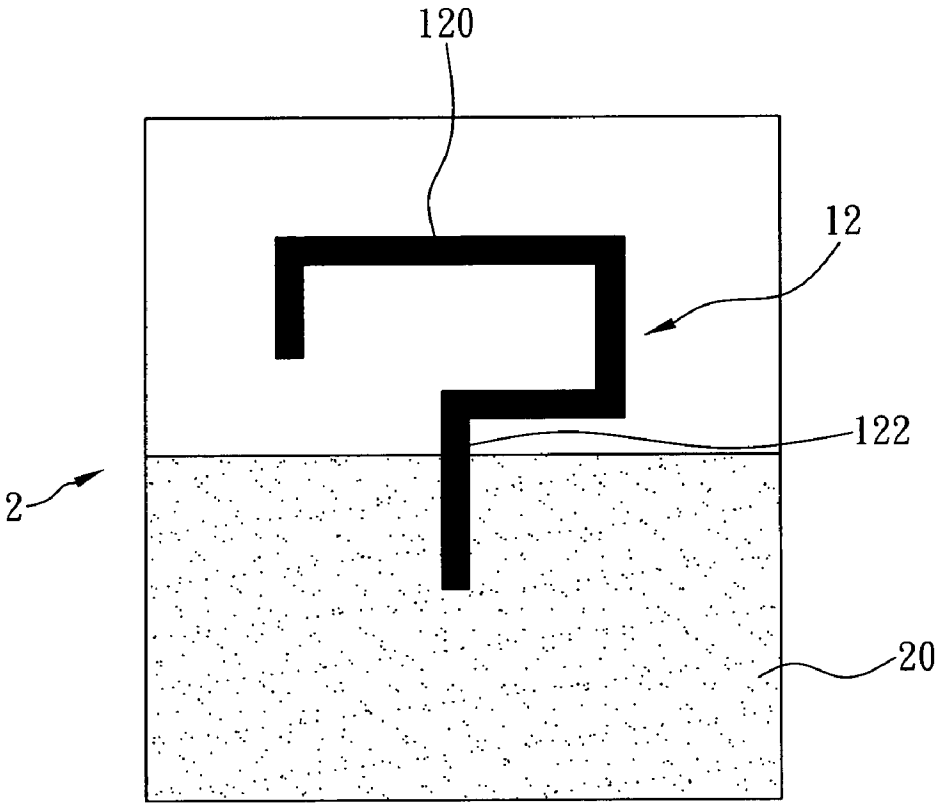
FIG. 2 (Prior Art)
FIG. 2 is a schematic view of a prior art printed monopole antenna.
Figure 3:
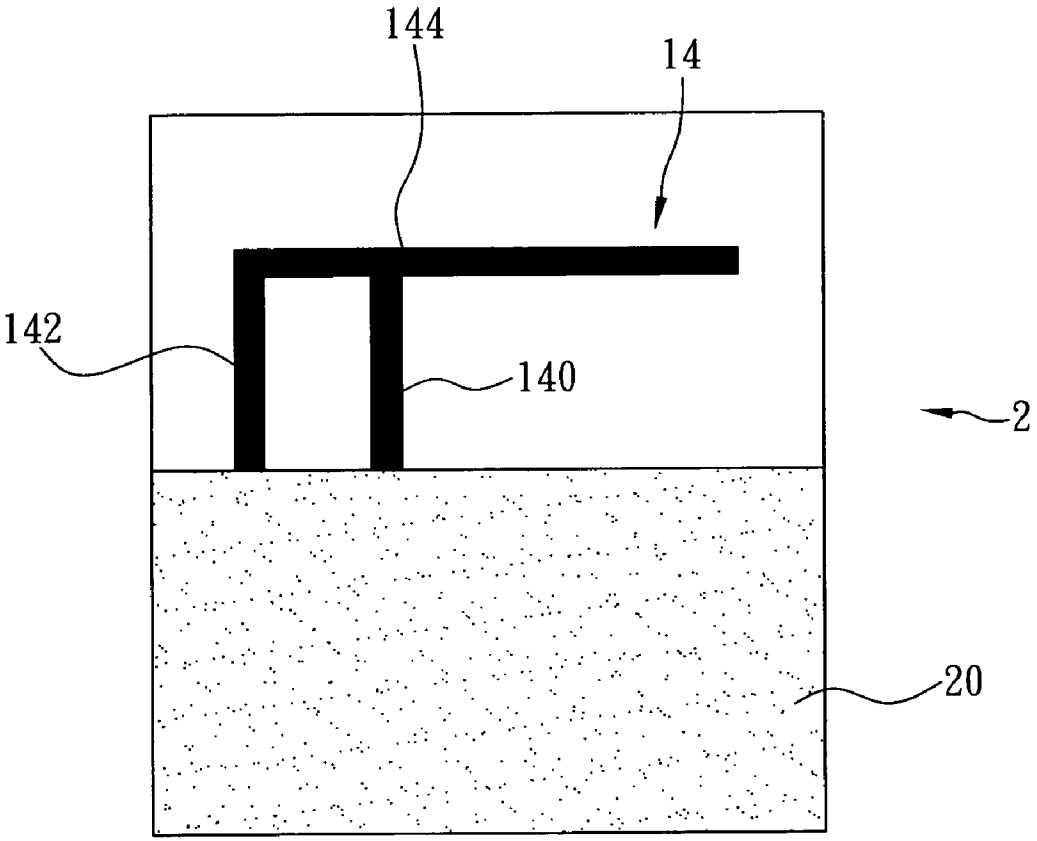
FIG. 3 (Prior Art)
FIG. 3 is a schematic view of a prior art inverted-F antenna.
Figure 4:
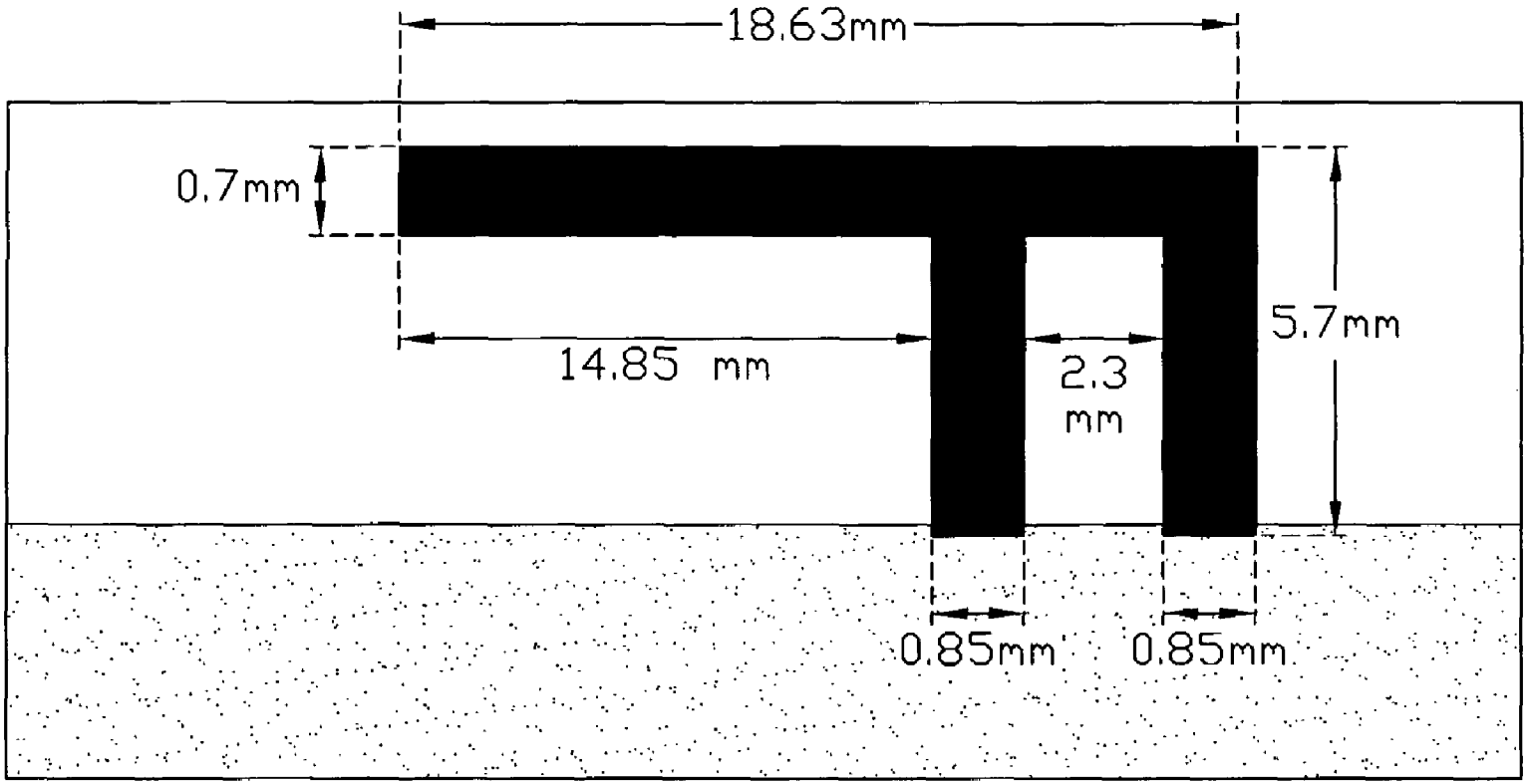
FIG. 4 (Prior Art)
FIG. 4 shows the actual dimensions of a prior art inverted-F antenna.
Figure 5:
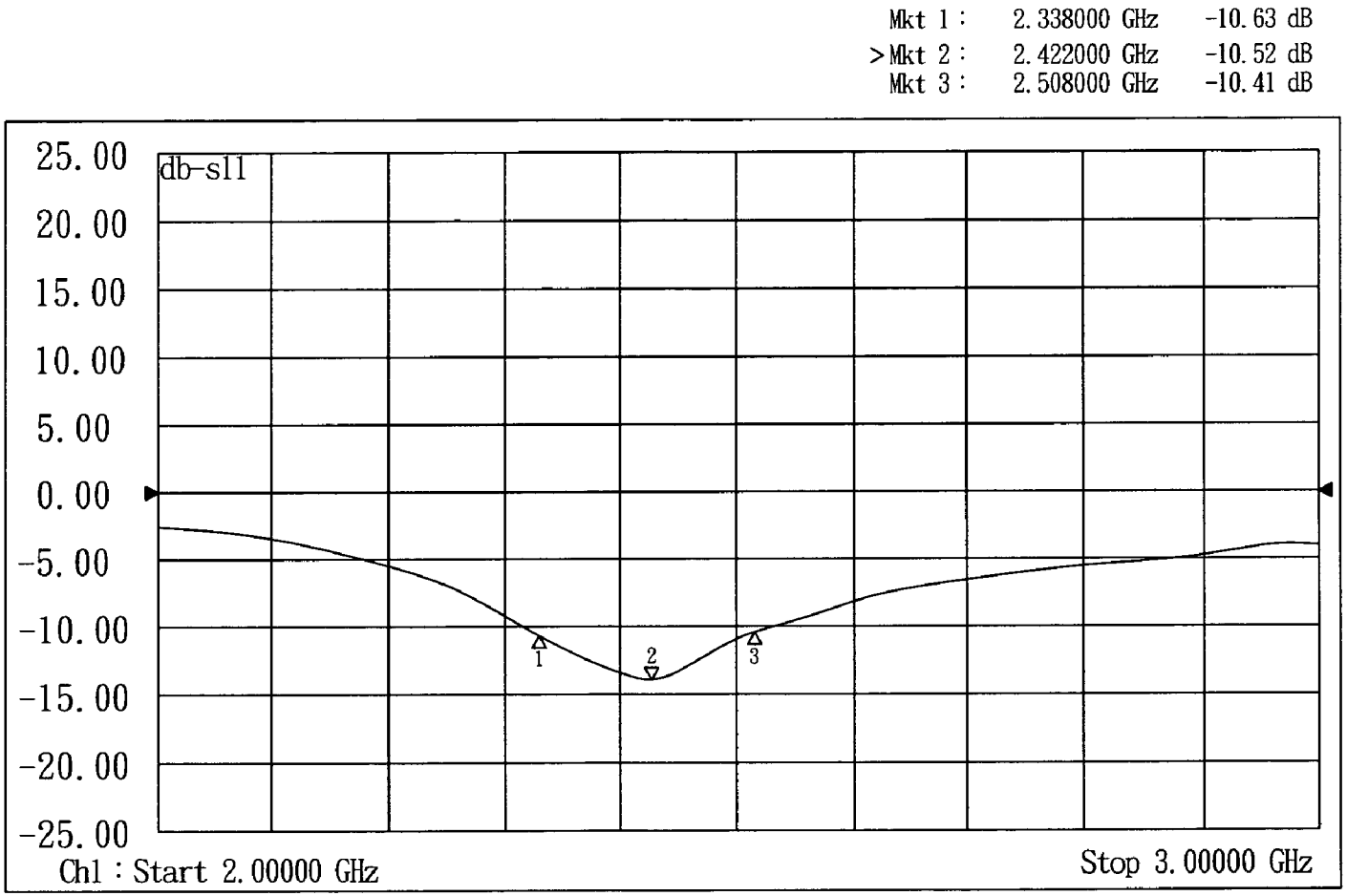
FIG. 5 (Prior Art)
FIG. 5 is a schematic view of bandwidth measurements of a prior art inverted-F antenna as depicted in FIG. 4.
Figure 6:
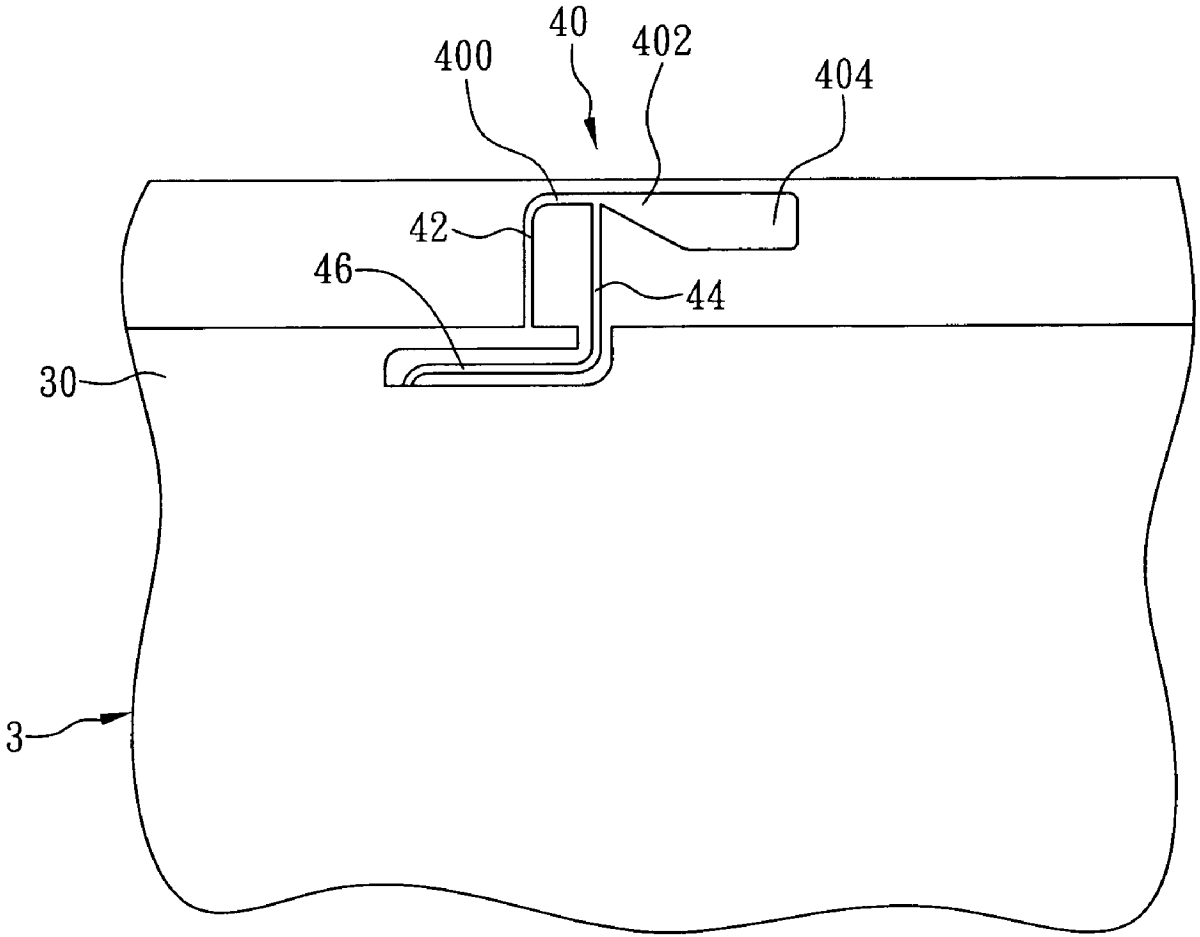
FIG. 6 is a schematic view of a structure of the present invention.

Referring to FIG. 6 for a broadband inverted-F antenna of the present invention, a circuit board 3 has a grounding plane 30 disposed at a position proximate to an edge of the circuit board 3, and the broadband inverted-F antenna is installed between the edge of the circuit board 3 and the grounding plane 30. The broadband inverted-F antenna comprises an antenna body 40, a short circuit line 42 and a feed line 44, wherein the antenna body 40 is composed of a first portion 400, a second portion 402 and a third portion 404. The wire width of the first portion 400 is smaller than the wire width of the third portion 404, and a constant wire width is maintained from an end to another end of the first portion 400, and a constant interval is maintained and extended to a predetermined length along the grounding plane 30. An end of the second portion 402 is connected to another end of the first portion 400, and the wire width of an end of the second portion 402 is equal to the wire length of the first portion 400, and extended gradually in a direction opposite to the first portion 400 until the wire width of another end of the second portion 402 is equal to the wire length of the third portion 404, and the third portion 404 is started from another end of the second portion 402 and formed by maintaining the same wire width between both ends of the third portion 404, and extending in a constant interval to a predetermined length along the grounding plane 30. Further, the first portion 400 is extended towards the grounding plane 30 from a position proximate to an end of the first portion 400 and in a direction facing a side of the grounding plane 30 to form the short-circuit line 42, and the first portion 400 is extended towards the grounding plane 30 from a position proximate to another end of the first portion 400 and in a direction facing a side of the grounding plane to form the feed line 44, which is in turn connected to a signal transmitting and receiving loop 46 of the circuit board 3. Thus, there is no metal existed between the second and third portions of the antenna body 40 and the grounding plane 30, and the effective bandwidth of the broadband inverted-F antenna can be used for adjusting the bandwidth required by a product without increasing the matching circuit, so as to effectively improve the tolerance for mass production and fit the mechanical casing design of different products.

Figure 7:
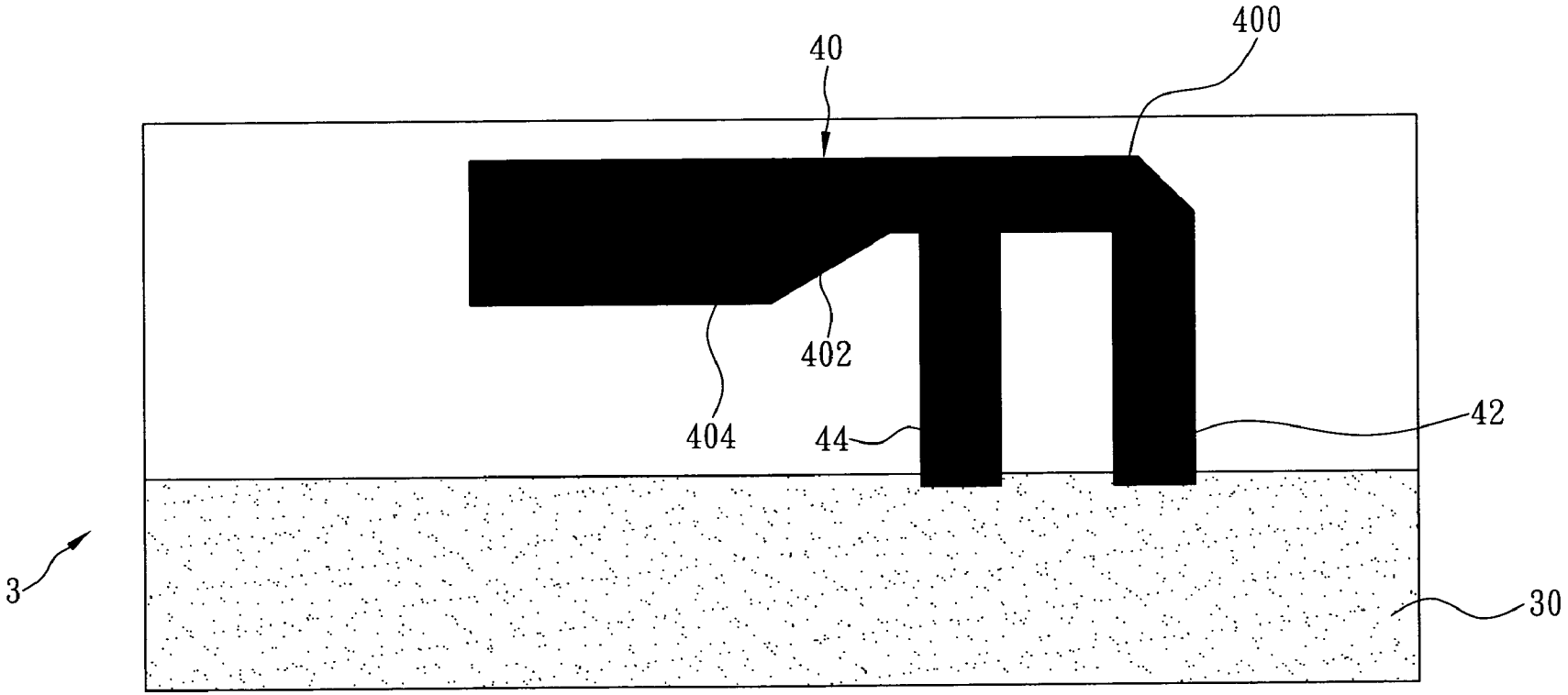
FIG. 7 is a schematic view of a first portion in accordance with a preferred embodiment of the present invention.
Figure 8:
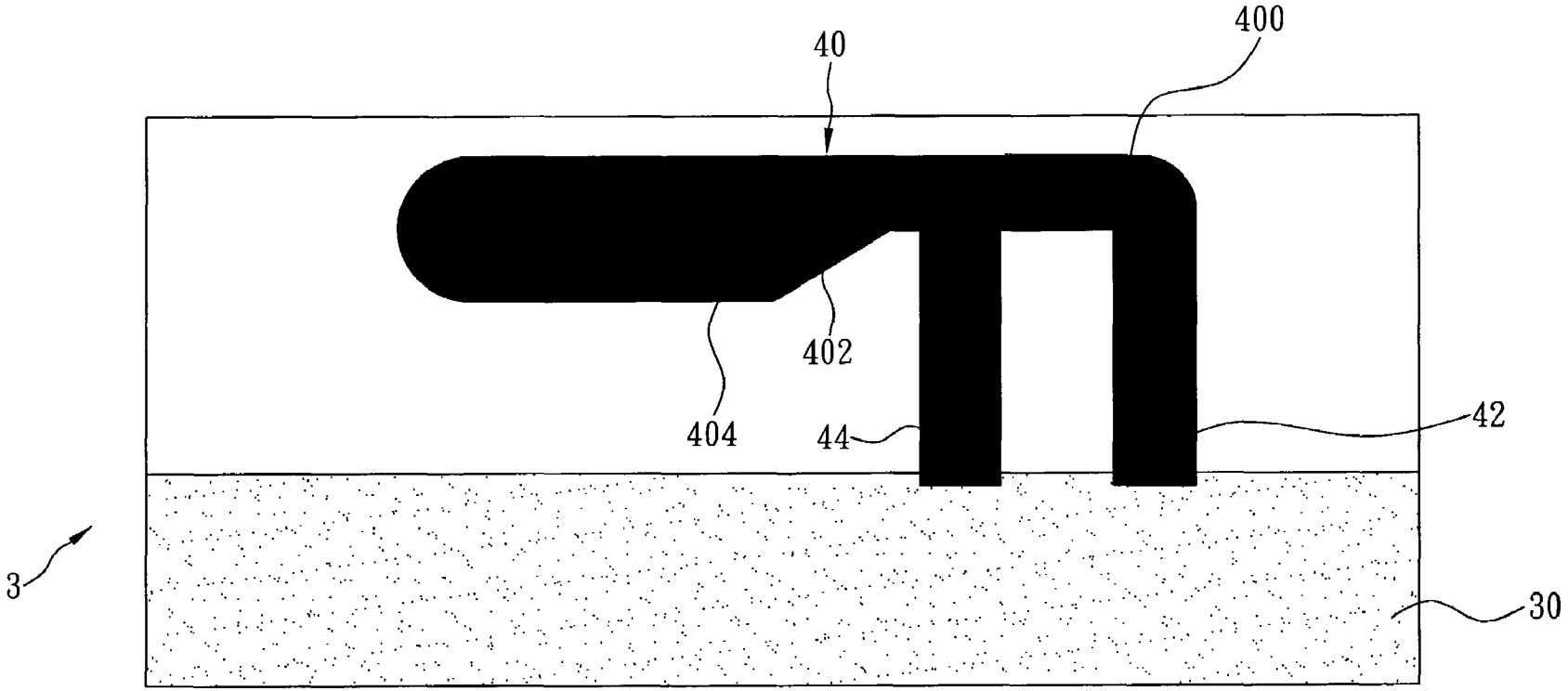
FIG. 8 is a schematic view of a first portion in accordance with another preferred embodiment of the present invention.
Figure 9:
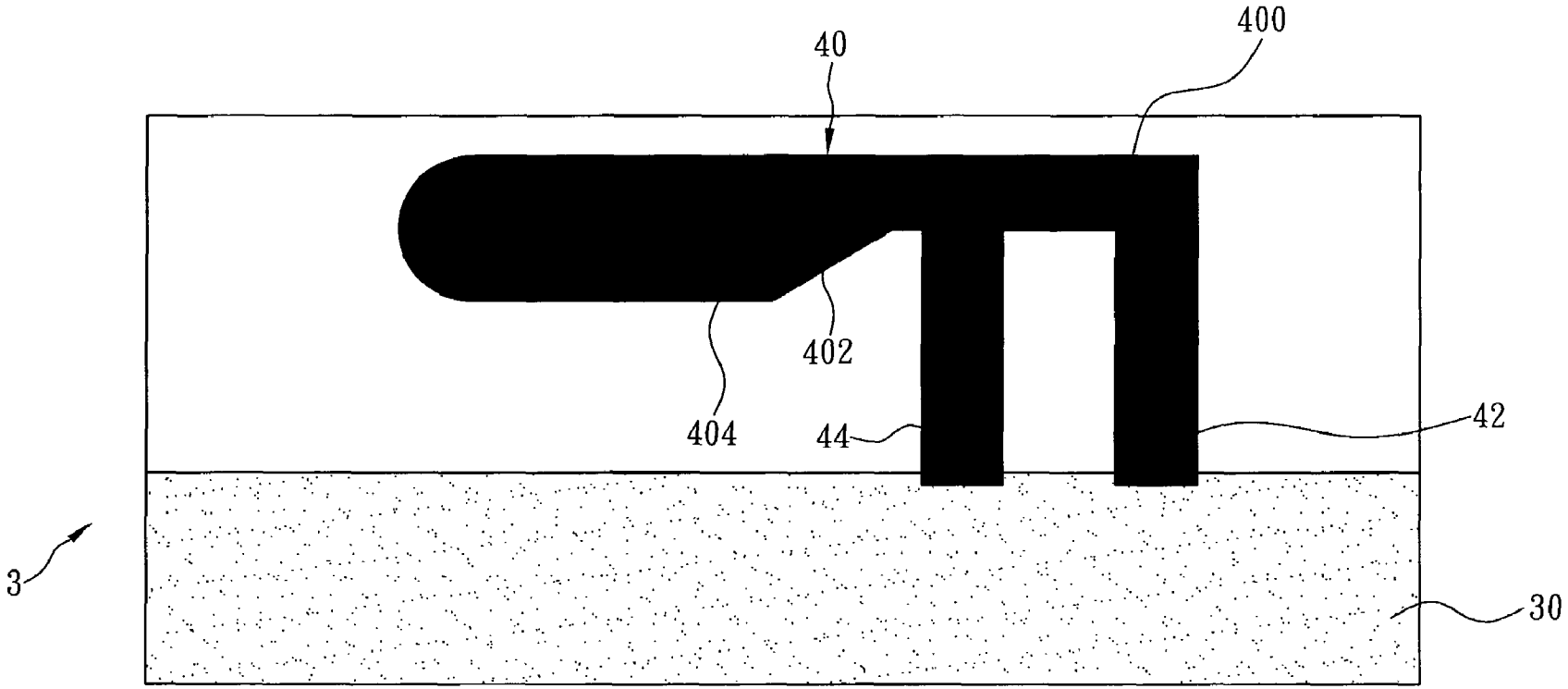
FIG. 9 is a schematic view of a third portion in accordance with a preferred embodiment of the present invention.

Referring to FIG. 6 for the present invention, the first portion 400 and the third portion 404 are rectangular metal microstrips, and the first portion 400 is extended and coupled to the third portion 404 to form the second portion 402 in a trapezium shape between the first portion 400 and the third portion 404. Further, a cut corner (as shown in FIG. 7) or an arc corner (as shown in FIG. 8) is formed on the first portion 400 at a position connecting to an end of the short circuit line 42 opposite to the grounding plane 30 without affecting the overall bandwidth of the antenna body. Further, an arc (as shown in FIG. 9) is formed on the third portion 404 at an end away from the second portion 402 without affecting the overall bandwidth of the antenna body.

Figure 10:
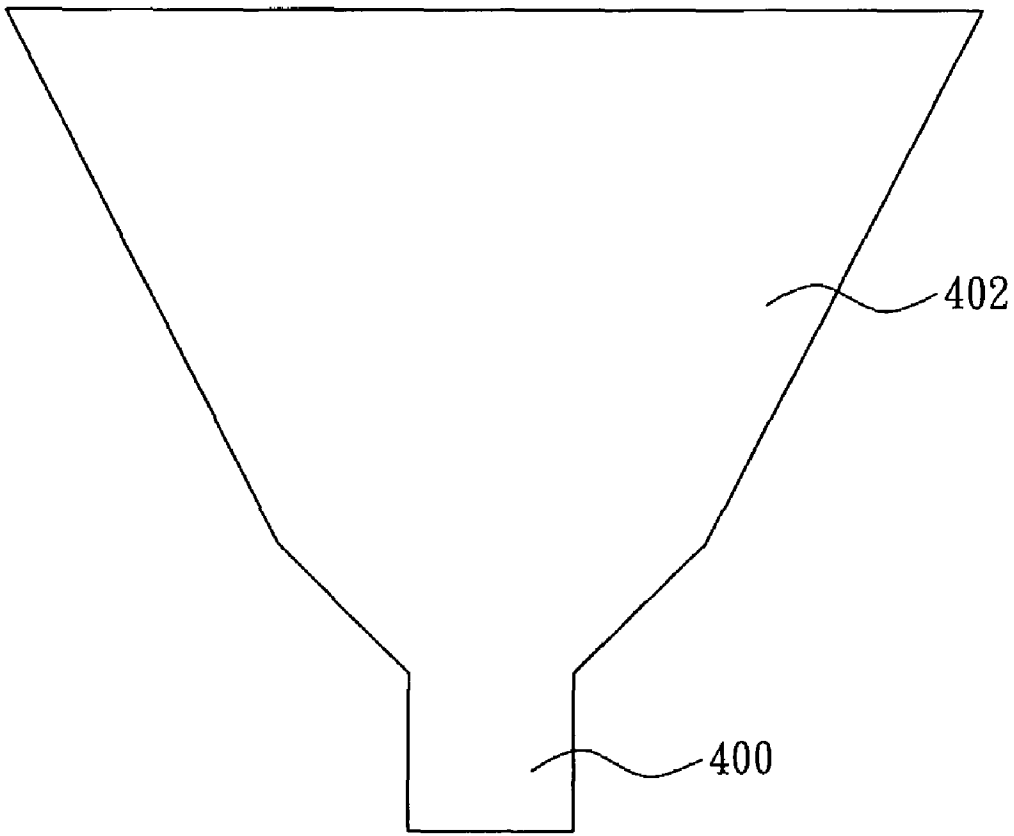
FIG. 10 is a schematic view of a second portion in accordance with a preferred embodiment of the present invention.

However, both first portion 400 and third portion 404 of the present invention are not limited to a rectangular shape only, and the second portion 402 is not limited to a trapezium shape only. Further, the wire width of an end of the second portion 402 may be unequal to the wire width of the first portion 400, and the wire width of another end of the second portion 402 may be unequal to the wire width of the third portion 400. Any wire width of the third portion 404 being larger than the wire width of the first portion 400, and the second portion 402 being extended gradually in a direction opposite to the first portion 400 are considered as variations or modifications easily obtained by any person ordinarily skilled in the art, and it is noteworthy to point out that these variations or modifications still fall in the scope of patent claims of the present invention. In FIG. 10, both sides of the first portion 400 are extended gradually outward at a first angle to a predetermined length, and then extended gradually outward at a second angle to a predetermined length, and coupled to both sides of the third portion, such that the second portion 402 in a bell-shape is formed between the first portion and the second portion.

Further, the antenna body 40, the short circuit line 42 and the feed line 44 are metal microstrips having a simple shape, and thus the antenna body 40, the short circuit line 42 and the feed line 44 can be produced easily in the manufacturing process of the printed circuit board, and the broadband inverted-F antenna can be introduced in a mass production to improve the production stability. By changing the conditions including the wire width and the length of the antenna body 40, the short circuit line 42 and the feed line 44 as the interval between the short circuit line 42 and the feed line 44 and the position of the feed line 44 for connecting the first portion 400 in a direction opposite to the grounding plane 30, the frequency of the broadband inverted-F antenna can be changed or fine tuned.

Figure 11:
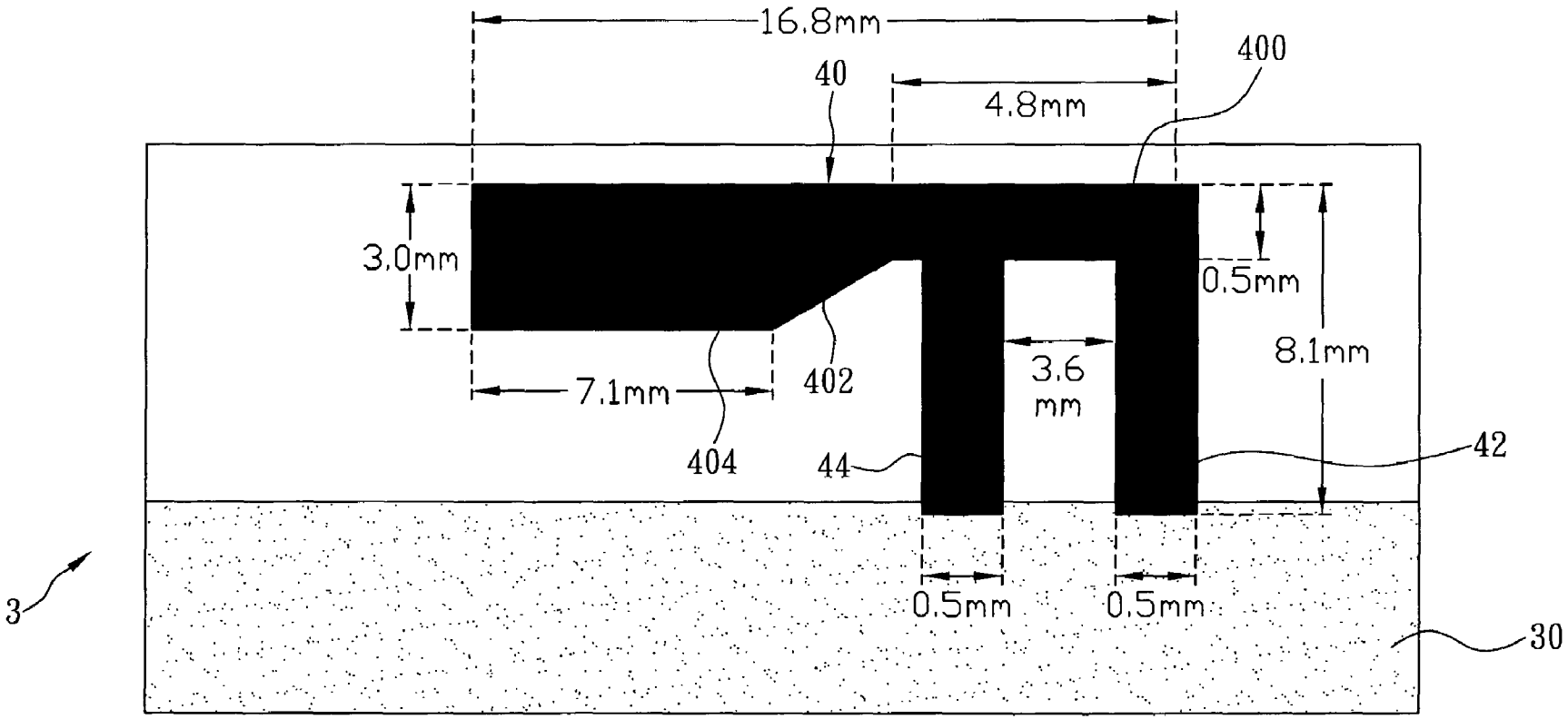
FIG. 11 shows the dimensions of a structure as depicted in FIG. 6.
Figure 12:
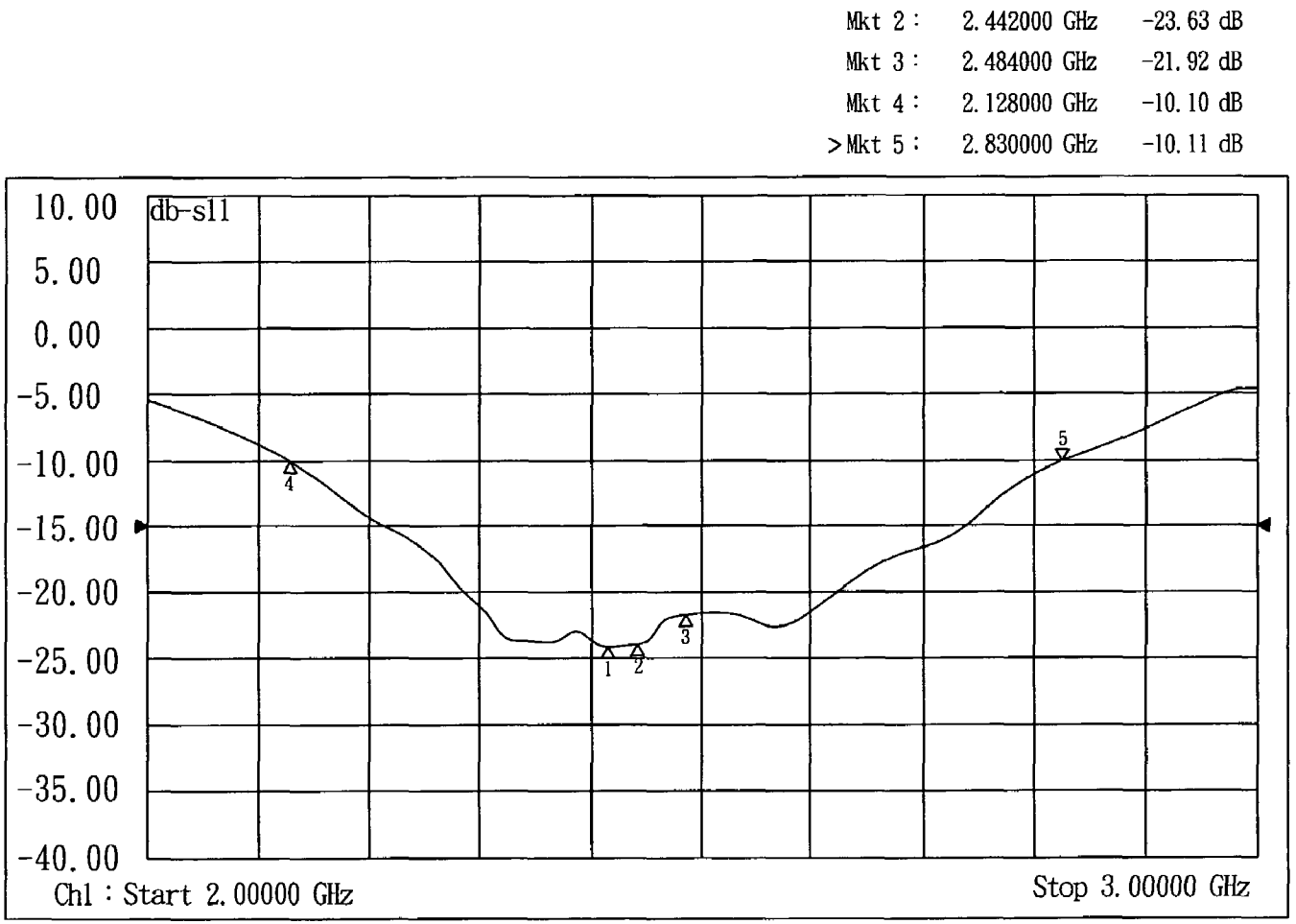
FIG. 12 is a schematic view of bandwidth measurements of an inverted-F antenna as depicted in FIG. 10.

Referring to FIG. 11 for the dimensions of an antenna structure as depicted in FIG. 6, the antenna body 40, the short circuit line 42 and the feed line 44 are built directly onto a printed circuit board, wherein the wire widths of the first portion 400, the short circuit line 42 and the feed line 44 are 0.5 mm, and the total length of the short circuit line 42 and the feed line 44 is 7.6 mm, and the interval between the short circuit line 42 and the feed line 44 is 3.6 mm, and the length of the first portion 400 is 4.8 mm, and the wire length of the third portion 404 is 3.0 mm, and the length of the third portion 404 is 7.1 mm, and the short circuit line 42 and the first portion 400 are perpendicular to each other, and the feed line 44 and the first portion 400 are perpendicular to each other, and the feed line 44 and the short circuit line 42 are parallel to each other. Referring to FIG. 12, the measured frequency of the broadband inverted-F antenna covers a range of approximately 702 MHz (from 2128 MHz to 2830 MHz), and the measurements indicate that the antenna gain is better than that of the traditional inverted-F antennas, in addition to the improvement on the increase of bandwidth.

To compensate the inductance of the feed line 44 and evenly distribute the current to the antenna body 40, the present invention uses the second portion 402 to complete matching the architecture, lowering the inductive effect of the feed and uniformly distributing current, so that the bandwidth of the antenna can have a larger coverage of transmitting and receiving signals. In the meantime, the structure forms the inductivity designed by the short circuit line 42, so as to overcome the problem of the capacitance and resume to one-quarter of a wavelength to achieve the effects of resonance and radiation as well as the expected effect of increasing the bandwidth. Therefore, the present invention can increase the bandwidth of the antenna without changing the original circuit board structure or adding an extra matching circuit.

While the invention has been described by means of specific embodiments, numerous modifications and variations could be made thereto by those skilled in the art without departing from the scope and spirit of the invention set forth in the claims.

What is claimed is:

1. A broadband inverted-F antenna, installed on a circuit board having a grounding plane at a position proximate to a lateral edge of the circuit board, and the broadband inverted-F antenna being disposed between the lateral edge of the circuit board and the grounding plane, comprising:

an antenna body, comprising a first portion, a second portion and a third portion, wherein the wire width of the first portion is smaller than the wire width of the third portion, the second portion is disposed between the first portion and the third portion, the wire width of the second portion is tapered from a first end to a second end thereof, the first end of the second portion is coupled to an end of the first portion that faces towards the third portion, and the second end of the second portion is connected to an end of the third portion that faces towards the first portion;

a short circuit line, disposed between a side of the first portion facing towards the grounding plane and the grounding plane, wherein an end of the short circuit line is connected to an end of the first portion opposite to the end connected to the second portion, and another end of the short circuit line is extended to the grounding plane; and a feed line, disposed between a side of the first portion facing towards the grounding plane and the grounding plane, wherein an end of the feed line is connected to the first portion at a position proximate to the first end of the second portion, and another end of the feed line is extended towards the grounding plane and connected to a signal transmitting and receiving loop of the circuit board.

2. The broadband inverted-F antenna as recited in claim 1, wherein the first portion and the third portion are rectangular metal microstrips.

3. The broadband inverted-F antenna as recited in claim 2, wherein the first end of the second portion is coupled to the end of the first portion facing towards the third portion, the second end of the second portion is coupled to the end of the third portion facing towards the first portion, such that the second portion is substantially in a trapezium shape formed between the first portion and the second portion.

4. The broadband inverted-F antenna as recited in claim 3, wherein a cut corner is formed on the first portion at a position connecting to the end of the short circuit line opposite to the grounding plane.

5. The broadband inverted-F antenna as recited in claim 3, wherein an arc corner is formed on the first portion at a position connecting to the end of the short circuit line opposite to the grounding plane.

6. The broadband inverted-F antenna as recited in claim 3, wherein an arc is formed on the third portion forms at the end away from the second end of the second portion.

7. The broadband inverted-F antenna as recited in claim 3, wherein the short circuit line and the first portion are perpendicular to each other.

8. The broadband inverted-F antenna as recited in claim 3, wherein the feed line and the first portion are perpendicular to each other, and the feed line and the short circuit line are parallel to each other.

9. The broadband inverted-F antenna as recited in claim 3, wherein the first end of the second portion has a wire width equal to the wire width of the first portion.

10. The broadband inverted-F antenna as recited in claim 3, wherein the second end of the second portion has another wire width equal to the wire width of the third portion.

11. The broadband inverted-F antenna as recited in claim 2, wherein the first portion has both sides extended gradually outward at a first angle to a predetermined length, and then extended gradually outward at a second angle to a predetermined length, and coupled to both sides of the third portion, such that the second portion in a bell-shape is formed between the first portion and the second portion.

* * * * *